United States Patent [19]

Mercer et al.

[11] 4,052,293

[45] Oct. 4, 1977

[54] METHOD AND APPARATUS FOR EXTRACTING OIL FROM HYDROCARBONACEOUS SOLID MATERIAL

[75] Inventors: James L. Mercer, Los Altos; Hachiro J. Togashi, Palo Alto, both of Calif.

[73] Assignee: CRYO-MAID Inc., Del.

[21] Appl. No.: 621,474

[22] Filed: Oct. 10, 1975

[51] Int. Cl.[2] ..... C10G 1/02

[52] U.S. Cl. ..... 208/11 R; 208/8; 201/32; 201/35

[58] Field of Search ..... 208/11 R, 8; 201/32, 201/35

[56] References Cited

U.S. PATENT DOCUMENTS

| | | | |
|---|---|---|---|
| 1,450,888 | 4/1932 | Illingworth | 201/35 |
| 1,916,900 | 7/1933 | Vandegrift et al. | 208/11 R |
| 1,978,984 | 10/1934 | Carter | 208/8 |
| 3,325,395 | 6/1967 | Ban | 208/11 R |
| 3,475,279 | 10/1969 | Bowman | 208/11 R |
| 3,483,115 | 12/1969 | Haddad et al. | 208/11 R |
| 3,652,447 | 3/1972 | Yant | 208/11 R |
| 3,791,994 | 2/1974 | Wenzel et al. | 201/35 |

*Primary Examiner*—Delbert E. Gantz
*Assistant Examiner*—James W. Hellwege
*Attorney, Agent, or Firm*—Flehr, Hohbach, Test, Albritton & Herbert

[57] ABSTRACT

A closed self-contained system (method and apparatus) for efficiently extracting oil and other hydrocarbons from oil-bearing hydrocarbonaceous solid material, which may be preheated to remove water and hydrocarbons which vaporize below about 600° F., is advanced in the form of discrete individual pieces along a pathway in a substantially evacuated zone (e.g., less than 50 torr) while in the presence of heat energy sufficient to raise the temperature of the shale (e.g., to 600° to no more than 900° F.) to cause the oil and other hydrocarbons to be liberated as a vapor in the evacuated zone. The hydrocarbonaceous solid material advances in proximity with at least one condenser surface so that oil and other hydrocarbons are condensed and recovered from the liberated vapor. The system operates at temperatures which are at all times below 900° F., and generally below 700° F., to extract the oil from the oil-bearing hydrocarbonaceous solid material in a relatively short period of time (e.g., 30 to 360 minutes).

9 Claims, 4 Drawing Figures

METHOD AND APPARATUS FOR EXTRACTING OIL FROM HYDROCARBONACEOUS SOLID MATERIAL

BACKGROUND OF INVENTION

It is well known that enormous potential stores of oil as well as gaseous hydrocarbons and other gases are contained in certain sedimentary rocks, commonly referred to as oil shale. Upon heating, such rocks yield appreciable quantities of relatively crude oil which may be refined to valuable products such as gasoline, diesel oil, jet fuel and fuel oil. Valuable byproducts such as tar acid and waxes are also recoverable from the crude shale oil. Very extensive deposits of oil shale are located in the United States, particularly in the states of Colorado, Utah and Wyoming, and important oil shale deposits are to be found in various parts of the world. Although even the best oil shales contain only about 0.6 to 0.8 barrels of oil per ton of shale, world conditions coupled with diminishing reserves of oil have led to considerable interest in developing a commercially feasible procedure for processing oil shale to recover its potential yield of crude oil. However, to date, such efforts have been unsuccessful with the result that this immense source of oil remains virtually untapped.

Present technology, upon which most recent research and development effort has been expended, includes mining, crushing and screening the oil shale to provide a particulate feed that can be heated to a sufficiently elevated temperature that a solid organic material within the shale, known as kerogen, can be decomposed by pyrolysis to shale oil, gas and a carbonaceous residue. Shale oil technology based on retorting has not achieved commercial or environmental acceptance for a number of reasons. For one thing, very high retorting temperatures of the order of 800° to 1200° F. or higher are required to carry out the pyrolysis reaction. Not only are the energy requirements enormous, but the decomposition of the organic compounds at such very high temperatures require immense volumes of air. Perhaps more important, the high temperatures contribute directly to pollution and like environmental problems through conversion of the organic materials to sulfides, amines and nitrogen compounds as byproducts from the retort. Effective removal of these pollutants to meet existing pollution standards normally requires use of an afterburner or other device which must be fired by an independent energy source (e.g., natural gas). In addition, the retorting process generally reduces the yield of oil from the shale, both from an inability of the retorting procedure to effectively process "fines" (which must therefore be screened from the shale) and the conversion of certain desirable components to undesirable components at the high temperatures employed. A further and particularly difficult problem is the generally high requirement for process water to effectively carry out the retort procedure. Thus as much as 2.5 barrels of water are required to process 1 barrel of oil from the shale, for purposes of quenching the high temperature residues and condensing volatiles on discharge.

But the foregoing relate only to problems associated with operation of the retort. When the shale has been processed, the residue must be returned to the ground. At the high retort temperatures employed to decompose the shale, irreversible changes take place which provide a further basis for polluting and degrading the land (e.g., contaminating surface waters and runoff passing through the spent shale). The problem of what to do with the poisonous residues from the shale process are, therefore, at least as great as those related to the processing of the byproduct gases and like pollutants.

Various alternative procedures have been proposed, for example, retorting the shale in place in the ground (in situ retorting) but, while minimizing the problems of spent-shale handling, such procedures do not avoid the problems associated with the use of high temperatures, as noted above. Steam distillation has also been proposed (see Egloff U.S. Pat. No. 1,627,162) and also the pyrolitic recovery of shale oil by means of pulsed laser beams within an enclosure from which gaseous products are withdrawn by vacuum pump (see Yant U.S. Pat. No. 3,652,447). However, such procedures have not proved to be successful and have never been commercialized. It is therefore apparent that a relatively simple, low temperature, safe procedure for processing oil shale to recover its oil content is highly to be desired.

SUMMARY OF INVENTION AND OBJECTS

The present invention relates generally to a method and apparatus for extracting oil and other hydrocarbons from hydrocarbonaceous solid material such as oil shale, tar sand coal, lignite and the like, and more particularly to a method and means for the efficient vacuum-extraction of oil and like hydrocarbons from oil-bearing shale rock at relatively low temperatures, and in relatively short periods of time.

As noted above, present technology requires that oil-bearing shales be retorted at very high temperatures of the order of 800° to 1500° F. to effectively separate the oil from the shale rock, with attendant difficulties. The present invention seeks to overcome this particular problem through use of a novel vacuum procedure wherein heat energy is supplied to the oil shale at relatively low temperatures, within the range from 600° to no more than 900° F. and generally below about 700° F., to cause the oil and other hydrocarbons within the oil shale to be liberated as a vapor in the evacuated system. Thereafter, the oil and other liberated hydrocarbons can be selectively condensed and recovered without the difficulties previously encountered with very high temperature processing.

As a general statement, the present invention is predicated on our discovery that oil and other hydrocarbons in various hydrocarbonaceous solid materials (oil shale, tar sands, coal, lignite) can be recovered by a process of advancing discrete individual pieces of the hydrocarbonaceous solid material along a pathway in a substantially evacuated system, that is, wherein the pressure is no more than about 50 torr, while simultaneously supplying heat energy to advancing pieces of material to raise the temperature to within the indicated range from about 600° to no more than 900° F. We have found that at temperatures within this range, and below about 700° F., the oil and other hydrocarbons within the oil shale are liberated as a vapor within the evacuated system, without any appreciable pyrolitic conversion of the liberated substances. Thereafter, the vapors can be selectively condensed to recover the desired oil and like hydrocarbon fractions from the vapors with minimum energy requirements and generally higher yields. The "spent" shale which is not subjected to any appreciable pyrolitic decomposition, is likewise generally in its original state, and can be appropriately returned to its source without concern as to environmental hazards. We have additionally found that our process can be carried out in a very short period of time, ranging from 30 to 360 minutes. In fact, generally less than about 70 minutes is required to recover at least 50% of the oil present in oil shales and like hydrocarbonaceous solid materials. In a preferred procedure, the solid material is heated within the substantially evacuated system by means of radiant heat energy supplied by a black body source at a temperature within the range from about 900° to 1500° F., so as to achieve vaporization of oil and like hydrocarbons from the solid material at the relatively low temperatures indicated.

Apparatus for carrying out the foregoing processing is generally characterized by its simplicity and includes a housing, means to evacuate the housing, a pathway for advancing oil shale or like solid material through the housing, means to supply energy to the pieces of shale advancing within the housing, at least one condenser surface within the housing in proximity with the pathway, means to supply cooling medium to the condenser surface, means to remove oil and other hydrocarbons condensing on the condenser surface within the housing, and means to feed the oil shale material to the housing and to remove the spent shale therefrom while maintaining the desired low pressure and temperature conditions. The process and system of apparatus is advantageously characterized by operations to extract oil from shale as described, without release of environmental contaminants to the atmosphere or return of solid contaminants to the soil.

It is accordingly an object of this invention to eliminate the undesirable features of known retorting and like processes for recovering oil and other hydrocarbons from oil shale or like hydrocarbonaceous solid materials, through reliance on processing within a substantially evacuated system at relatively low temperature.

Another object of the invention is to provide a novel method to extract oil and other hydrocarbons from hydrocarbonaceous solid materials which virtually eliminates release of envionmental contaminants to the atmosphere or the return of such contaminants to the soil.

Another object of the invention is to provide an oil and hydrocarbon extraction process of such character which employs an extraction pathway in a substantially evacuated system, whereby relatively low temperatures can be employed to liberate the oil and other hydrocarbons from the oil-bearing solid material for subsequent selective condensation and recovery.

A further object of the invention is to provide a system of apparatus for carrying out the foregoing processing which is relatively simple in construction and characterized by low energy requirements and inexpensive operation, and which necessitates a minimum of supervision.

Additional objects and advantages of the invention will appear from the following description in which an illustrative embodiment has been set forth in detail in conjunction with the accompanying drawing.

DETAILED DESCRIPTION OF THE DRAWING

Figure 1:
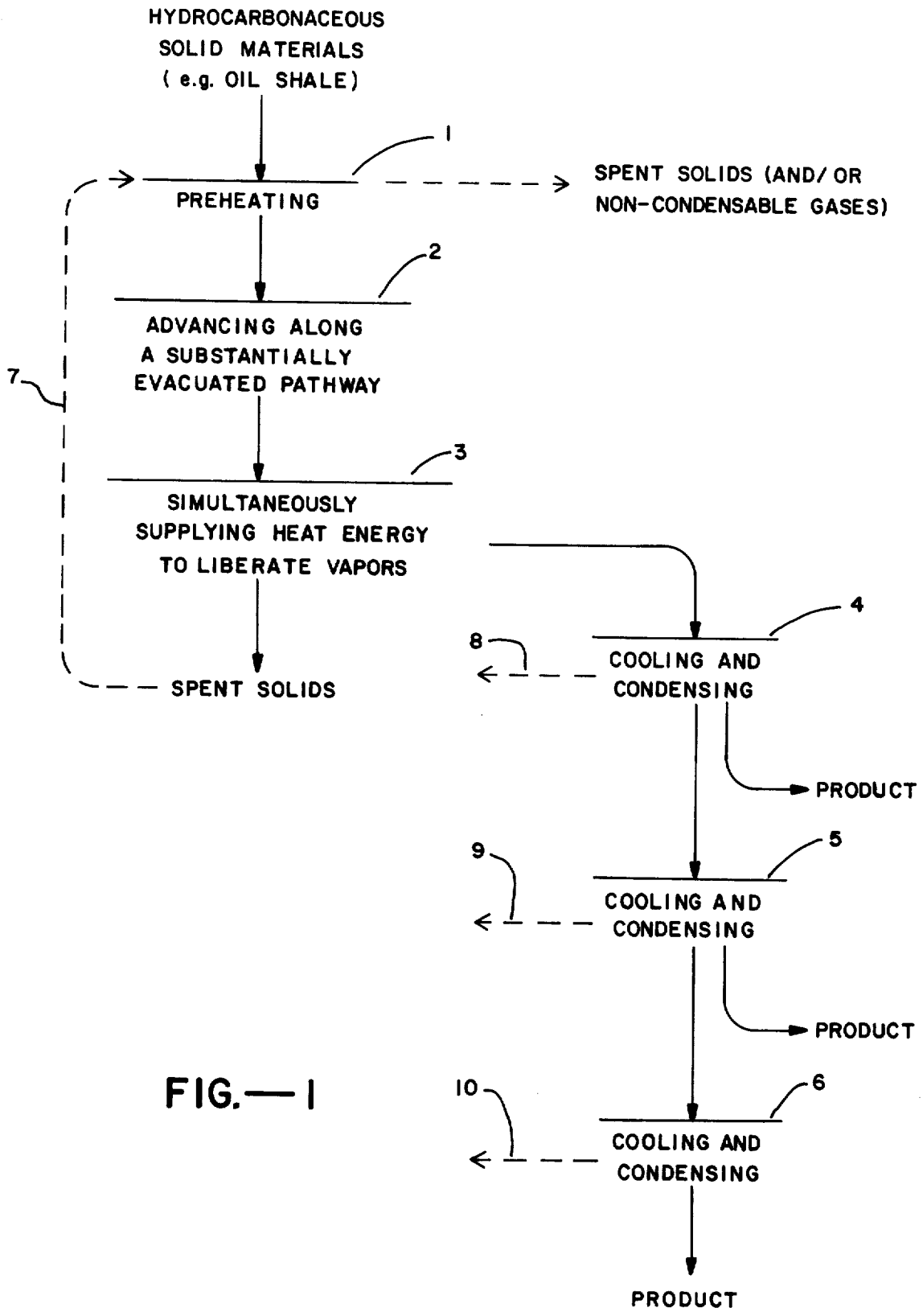
FIG. 1 is a flow sheet illustrating the general method of the present invention.

Referring to the drawings, FIG. 1 represents a general flow sheet of our new oil extraction method, and particularly illustrates the main steps in sequence.

In step 1, an oil-bearing solid material such as oil shale, is initially preheated at a relatively low temperature below about 600° F. to drive out water and hydrocarbons which volatilize at temperatures below 600° F. The purpose of this step is generally to reduce the energy required and to simplify the processing within the vacuum extraction steps which follow.

In step 2, the preheated solid material is subjected to vacuum extraction while being advanced along a pathway in a substantially evacuated zone, that is wherein pressures are substantially below atmospheric. Generally, the pressure within the evacuated zone will be less than 50 torr, and, preferably, will be within the range from 1 to 10 torr.

In step 3, which is carried out simultaneously with step 2, the advancing solid material is subjected to heat energy sufficient to raise the temperature of the oil-bearing solid material to a point where the oil and other contained hydrocarbons are liberated as a vapor. In accordance with the present invention, wherein reliance is placed on vacuum extraction, this temperature will be in the range from about 600° to no more than 900° F. and, generally, will be below 700° F. While various procedures can be employed to supply heat energy to the advancing solid material, including contact or conduction type heating units, we have found radiant heat energy to be most advantageous for such purpose.

In general, the vacuum extraction of oil and like hydrocarbons from oil-bearing shale can be carried out in steps 2 and 3 in a relatively short period of time, ranging from about 30 to 360 minutes. We have specifically found that, at temperatures below about 700° F., the time to remove at least 50% of the oil present in most oil-bearing shales is less than about 70 minutes.

In steps 4, 5 and 6, the vapors liberated in the vacuum extraction steps 2 and 3 are cooled and condensed for recovery of the end product. Thus, in the case of oil shale, the liberated vapors are cooled to about 200° to 300° F. in step 4, to condense the heavy crude oils and like relatively high boiling fractions. Remaining vapors are thereafter cooled in step 5 to about 30° to 200° F. to condense intermediate oil fractions. In step 6, remaining vapors are cooled to temperatures ranging down to −300° F. to condense light oil fractions and any remaining water vapor. In this way, the liberated vapors are subjected to selective cooling and fractional condensing of the various hydrocarbon components in the oil shale to effect recovery of the same. In general, the selective condensing and recovery of the hydrocarbon components in steps 4, 5 and 6 is carried out more or less simultaneously with the vapor extraction in steps 2 and 3, in a substantially continuous process.

The processing in accordance with the foregoing method provides a number of distinct advantages. For one thing, the vacuum extraction in steps 2 and 3 can be carried out with minimum energy requirements and at temperatures substantially lower than those previously employed in conventional retorting procedures. Thus, at a preferred extraction temperature of the order of 650° F., pyrolitic conversion of the liberated vapors as well as components remaining in the shale is substantially avoided, with very specific benefits as respects both the quality of the yield and avoidance of environmental contamination (atmosphere or soil). The method also permits the processing of hydrocarbonaceous solid materials in a wide range of particle sizes, ranging from previously troublesome fines up to gross or rock size pieces. The method is also adaptable to the processing of oil shales of very high oil content (e.g., 40 gallons per ton), and provides particular advantages as respects energy requirements in that heat energy input is greatly reduced, and the necessity for high volumes of water for quenching and like operations is avoided.

As further illustrated in FIG. 1, beneficial results can be obtained in the practice of our invention by means of energy conservation through recovery of process energy and materials. Thus, the spent solids discharged from step 3 can be recycled for purposes of employing residual heat energy in the preheating of step 1. Such recycling is represented in the drawing by the dotted arrow 7. In like fashion, heat contained in noncondensable byproduct gases from any of steps 4, 5, and 6 can be employed for various plant operations, for example, in the preheating of step 1 or for more conventional purposes such as the heating of boilers, process lines and the like (see arrows 8, 9 and 10).

Figure 2:
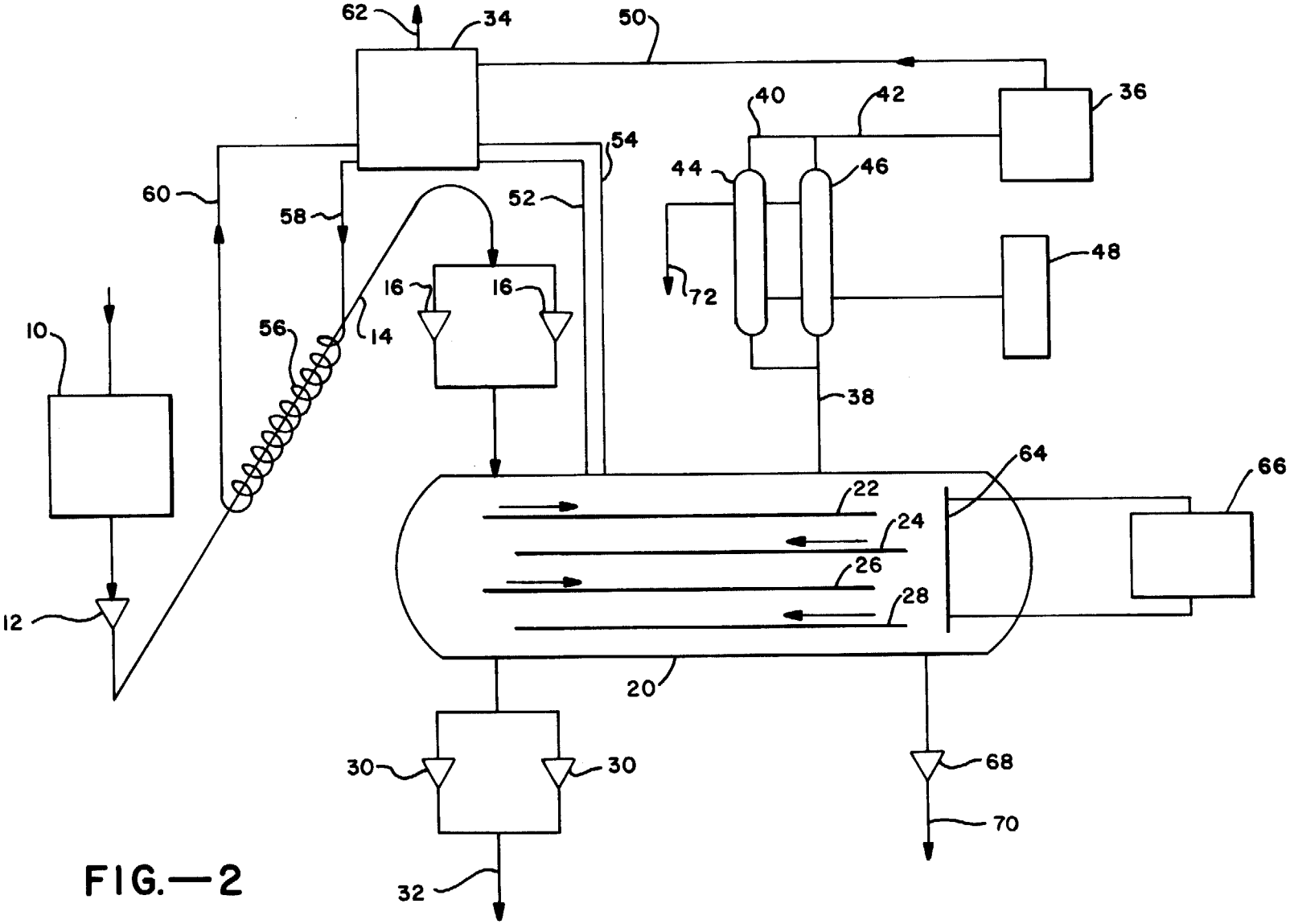
FIG. 2 is a schematic representation of a system of apparatus which is useful in carrying out the method of the invention.

FIG. 2 schematically illustrates a system of apparatus for carrying out our oil extraction method on a continuous basis, and additionally illustrates certain refinements in the processing to achieve an efficient plant operation. Having reference to oil-bearing rock, the processing is initiated by feeding the rock to a crusher 10 which functions to reduce the rock to a particle size of the order of ½ inch. The broken pieces of rock fall into the hopper 12 for delivery to a jacketed screw conveyor 14 wherein the rock is heated from ambient temperature to a desired preheat temperature of the order of 600° F. The crushed preheated rock is then delivered to the vacuum extraction process through double vacuum locks 16, which are used alternatively to minimize down time.

As schematically illustrated in FIG. 2, the extraction process is carried out in an evacuated, substantially airfree chamber 20 wherein a plurality of conveying means 22, 24, 26 and 28 are provided for conveyance of the oil shale through the extraction process. Any suitable conveying means may be employed, for example, vibratory conveyers of the type disclosed in Rowell U.S. Pat. No. 3,667,135. As therein described, particulate material is conveyed with a bouncing or dancing motion which functions to periodically rotate and turn the particles as they advance along the conveyor. As further described in the Rowell patent, the conveying decks can be provided with coils to conduct heating fluid for supplying radiant heat energy as hereinafter described. In the functioning of the apparatus, the oil-bearing shale is delivered to the left end of conveyor 22 from which it falls onto the right end of conveyor 24 and, in sequence, to the left end of conveyor 26 and to the right end of conveyor 28, until the spent shale is eventually delivered to the double locks 30 for discharge from the system (see arrow 32). In the schematic representation of FIG. 2, no mechanism is illustrated for recovery of heat in the spent shale discharged at 32, although as noted previously, such processing would be advantageous (see step 7 in FIG. 1).

For purposes of carrying out the extraction process, radiant energy heating units (not shown) are provided above each of the four conveyor decks 22, 24, 26 and 28. When employing conveyance means of the type disclosed in the aforementioned Rowell patent, the radiant heat energy is supplied by circulating fluid within the indicated temperature range within the heating coils of the separate conveying decks. Thus, the heating coil for conveying deck 22 would be positioned adjacent the top of chamber 20 whereas the heating coils for the conveyance decks 24, 26 and 28 would form part of the lower surfaces of the decks 22, 24, and 26, respectively. In addition, heat is also supplied to material advancing on each deck by the contained heating unit (i.e., coils) within each deck, that is, by direct contact of the deck surfaces with the advancing solid material.

In any event, the function of the radiant heating units is to heat the advancing shale material on the conveying decks to a temperature of the order of 600° to 700° F. (and not in excess of 900° F.) tocause the oil and other hydrocarbons in the oil shale to be liberated as a vapor within the evacuated chamber 20. As hereinafter described, heating fluid for the various radiant heating units is circulated from a plant heating unit, as generally represented at 34.

As previously indicated, it is a feature of the present invention that the oil extraction process is carried out within a closed evacuated system as represented by the chamber 20. As schematically illustrated in FIG. 2, the chamber 20 is evacuated by means of a vacuum pump 36 which operates to pull a vacuum on chamber 20 through the line 38 and branch lines 40 and 42 connected, respectively, with the condensing units 44 and 46. In general the vacuum pump 36 functions to evacuate the chamber to a pressure generally below 50 torr, and within the range from about 1 to 10 torr. A refrigeration system, schematically represented at 48, functions to maintain coolant temperatures within the condenser 44 and 46 of the order of −100° F., to insure effective condensation of all recoverable materials prior to discharge of the remaining noncondensable gases through vacuum pump 36 and line 50. As indicated in FIG. 2, the noncondensable gas fractions exhausting through vacuum pump 36 to the plant heater 34 contain sufficient heat energy to generally support the energy requirements for the extraction system.

As shown in the schematic representation of FIG. 2, the plant heater 34 functions to elevate the temperature of heat exchange fluid circulated to the radiant energy heating units, through continuous circulatory lines 52 and 54. In like fashion, the plant heater supplies heat energy for the preheating jacket 56 for the inlet conveyor 14, through the continuous circulatory lines 58 and 60. For such purpose, the plant heater 34 can be a conventional boiler or like heating unit capable of being controlled to continuously heat and maintain the circulating fluids at the desired heat exchange temperature. It is also a feature of importance that the heat energy for the plant heater 34 is derived from the exhaust gases discharged from the evacuation chamber 20, thus further serving to remove potential environmental contaminants from the exhaust line (see arrow 62).

In addition to the exhaust condensing units 44 and 46, a condenser 64 can be positioned internally of the extraction chamber 20, to effect preliminary condensation of the higher boiling or "heavy" crude oil fractions. As chematically illustrated in FIG. 2, this condensing unit s operated by means of a conventional water tower ystem as schematically represented at 66. In general, he condensing unit 64 provides a cooling and condens- ng function corresponding to step 4 in FIG. 1, whereas he condensing units 44 and 46 provide cooling and condensing functions corresponding to steps 5 or 6 of FIG. 1.

Figure 3:
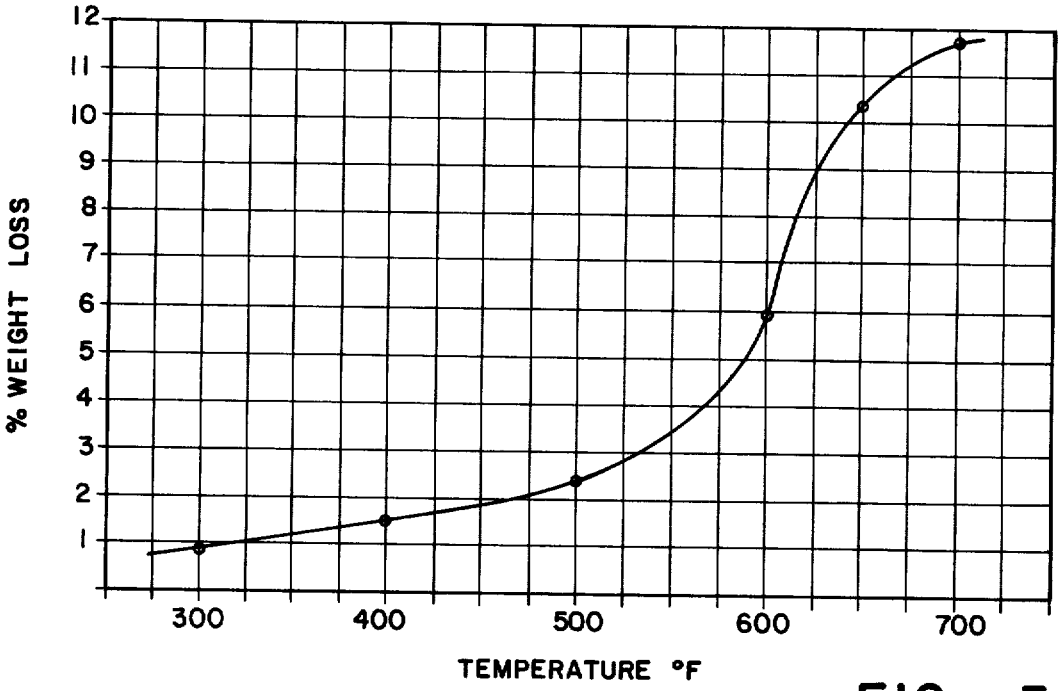
FIG. 3 is a graph illustrating the recovery of oil and like hydrocarbons according to the method of the present invention, as a function of temperature.

As previously noted, it is a particular feature of the present invention that the vacuum extraction steps can be carried out at a relatively low temperature, preferably below about 700° F. As generally illustrated in the graph of FIG. 3, this is made possible by the fact that the extraction is carried out within a substantially evacuated chamber. Specifically, FIG. 3 is a plot of the weight loss obtained in a substantially evacuated system (1 torr) in response to incremental increases in the temperature of oil shale ore samples held within the evacuated system. In carrying out the test plotted in FIG. 3, oil-bearing shale rock which has been reduced in size (100% — 6 mesh, 84.7% — 8 mesh, 40.8% — 16 mesh, U.S. Standard Screen Series) was maintained in a static controlled bed within an evacuated chamber at different temperatures, maintained for periods of 2 hours. Thus, in a preliminary heating stage to about 375° F. in vacuum (which would correspond to a preheating step at atmospheric pressure to about 600° F.), approximately 1.4% of the volatiles were liberated. Upon raising the temperature to 650° F. under the vacuum conditions, nearly 9% of additional volatiles were rapidly liberated to achieve a total weight loss of approximately 10.4%. Thereafter, upon increasing the temperature to 700° F., the rate of liberating gaseous hydrocarbons decreased somewhat to achieve a total weight loss of about 11.8%. Significantly, the plot in FIG. 3 demonstrates that the important hydrocarbon volatiles (corresponding to heavy, intermediate and light crude oil fractions in the oil shale) were substantially liberated within the relatively narrow temperature range from 400° to 700° F. In fact, within a range of pressures from about 1 to 10 torr, it is demonstrated that the most desirable crude oil fractions in available oil shale sources are substantially liberated within the relatively narrow temperature range from about 500° to 650° F. FIG. 3 thus particularly demonstrates the advantageous feature of the extraction method of the present invention, which is carried out in a substantially evacuated system within a relatively low and narrow range of extraction temperatures.

Figure 4:
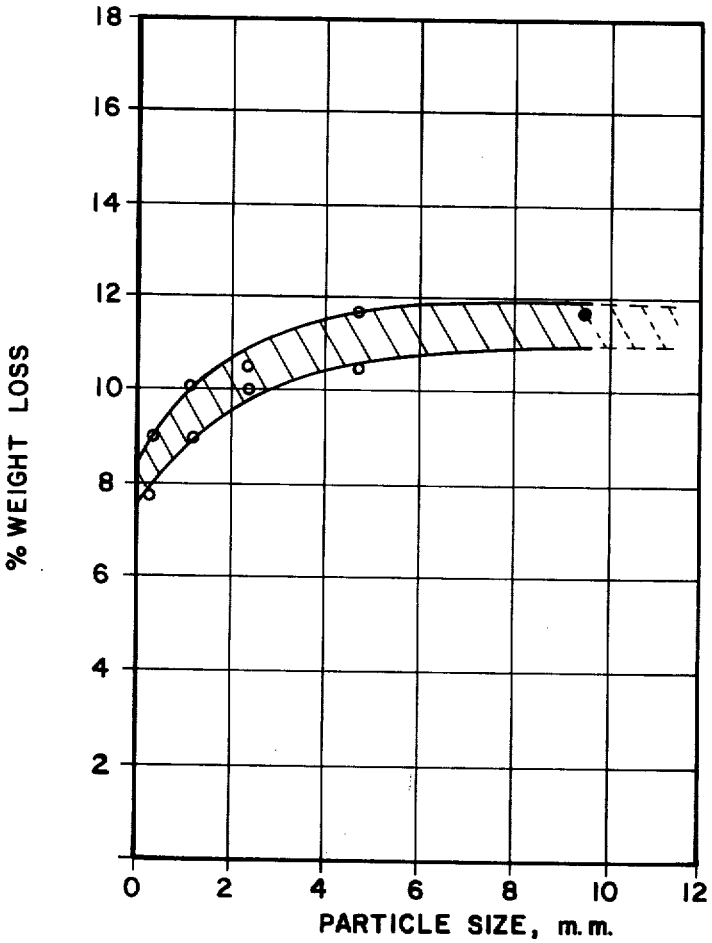
FIG. 4 is a graph similarly illustrating the recovery of oil and like hydrocarbons according to the method of the present invention, as a function of the particle size of the solid material.

FIG. 4 is a somewhat similar plot related specifically to variations in the particle size of the oil-bearing shale samples. In this test, which similarly plots the weight loss in an evacuated system at an extraction temperature of 700° F., various size oil shale particles were held for a period of 2 hours to determine the total of weight loss as a function of particle size. Thus, at particle sizes of the order of 4 to 10 millimeters and above, the percent weight loss was relatively constant and approximated 10.5 to 12% of the total weight of the shale. Upon reducing the size of the oil shale particles, for example, to an average particle size of 2 millimeters, the percent weight loss was slightly reduced to within an indicated range from about 9.5 to 10.5%. At smaller sizes approaching the dimensions of fines (e.g., 0.5 mm or less), the percent weight loss was reduced to approximately 8%. The general indication of FIG. 4, therefore, is that the processing of the present invention is effective to liberate contained oil and other hydrocarbons from oil shale, regardless of the size of the shale particles subjected to processing. Thus, while best results are obtained with particles of the order of ¼ to ½ inch or larger, even fines can be effectively processed for significant recovery of contained oil and like hydrocarbons.

Features and advantages of the herein described vacuum extraction method for recovery of oil and other hydrocarbons from oil shale are demonstrated by the following exemplary disclosure related to the system of apparatus as schematically illustrated in FIG. 2.

EXAMPLE

Assuming continuous operation of an oil shale plant to provide processing of 125 tons of oil shale per day for purposes of extracting oil and other hydrocarbons, oil-bearing shale rock is fed to the crusher 10 at the rate of about 10,400 pounds per hour. Within the crusher 10, the shale rock is reduced to approximately ½ inch size for discharge to the feed hopper 12. It will be appreciated, however, that fines and particles somewhat larger than ½ inch will generally be fed to the system. The shale rock at ambient temperature (70° F.) is moved upwardly through the conveyor 14 and through the preheater 56, which raises the temperature of the shale particles to approximately 600° F. The shale is discharged alternatively to one or the other air locks 16 for introduction into the evacuated chamber 20 which is maintained at a pressure of about 5 torr, for delivery onto the surface of the uppermost vibratory conveyor 22. As the oil-bearing shale material moves successively along the surfaces of the conveyors 22, 24, 26, and 28, it is continuously and progressively subjected to the heat energy of the radiant heating units positioned above (and within) each conveyor, through which heat exchange fluid (viz, a eutectic mixture of 26.5% by weight diphenyl and 73.5% diphenyl oxide) is continuously circulated. In accordance with the invention, the temperature of the radiant heating units (about 750° F.) is sufficient to raise the temperature of the oil shale to about 650° F. At the same time, the oil shale is subjected to the effects of the relatively low (5 torr) pressure within the substantially evacuated chamber 20. When the temperature of the oil shale has been elevated to about 650° F., the oil and other hydrocarbons within the shale are liberated as a vapor within the chamber 20. The condensing surface 64 is maintained at a temperature of approximately 60° F. and functions to cool or condense the relatively heavy crude oil fractions which condense above this temperature so that they collect in the bottom of the chamber for discharge through the air lock 68, and recovery at 70. Assuming a feed to the crusher of oil-bearing shale from Utah having an assay of about 30 gallons per ton of shale, the recovery of crude oil at 70 will approximate about 78.5 gallons (1.87 barrels) per hour. Simultaneously, noncondensed gases within the chamber 20 are withdrawn through line 38 through the condensing units 44 and 46. As previously noted, these condensing units are maintained at a temperature of about −100° F., with the result that virtually all the remaining oil and remaining hydrocarbons in the liberated gases are condensed for recovery through line 72. On the basis of the previous assumption with respect to the feed material, light oil fractions recovered at 72, approximate 39 gallons (0.93) barrels per hour. In addition, about 145 pounds of water per hour are discharged through line 72. Spent shale from the processing is alternatively discharged through one or the other of the air locks 30, for discharge at 32. The rate of discharge is approximatly 9,380 pounds of spent shade per hour, the temperature of the spent shale being approximately 700° F.

The indicated recovery of oil in the described continuous oil extraction process approximates 117.5 gallons (2.8 barrels) per hour, or about 282 (67 barrels) of crude oil per day, based on 24 hours of continuous operation. The percent recovery or "yield" is therefore about 75% of the crude oil available in the oil-bearing material fed to the system. In general, indicated recoveries are within the range from about 60 to 80%, or higher.

Many variations are possible in the processing herein described and in the arrangement and use of the disclosed system of apparatus. For example, although the disclosures specifically relate to the vacuum extraction of oil-bearing shale, the procedures and apparatus herein described can be employed in the vacuum extraction of various solid particulate materials such as tar sands, lignite and like hydrocarbonaceous solid materials. It is particularly contemplated, for example, that coal for steel plants and like industries utilizing coal could be preliminarily processed to remove volatile fractions so as to provide "clean" coal supplies to prevent atmospheric contamination. It is further contemplated that the vacuum extraction method as herein disclosed could be adapted, with certain modifications, to the vacuum extraction of oil bearing shale rocks in situ. Thus, by means of known relatively inexpensive procedures (e.g., tremie placement of cementitious curtain walls and drilled in place radiant energy heating units), oil shale might be vacuum extracted within an enclosure constructed in the ground, without necessity for disturbing the terrain and with appreciable recoveries. The relatively low temperatures capable of being employed for such vacuum extraction processing would eliminate soil contamination as well as other problems normally associated with conventional retorting. It is further contemplated that specific systems of apparatus, other than as illustrated in FIG. 2, might be more conveniently employed in carrying out the method of the invention. Thus, a particular modification would be to employ jacketed screw conveyors in place of vibratory conveyors 22 - 28, thus minimizing conveyor costs while maximizing the use of vacuum space for the extraction processing. Many other variations which will similarly occur to those skilled in this art can be easily adapted to the disclosed continuous process and system of apparatus, without changes in the overall concept. Accordingly, it should be understood that the disclosures herein are intended as purely illustrative and not in any sense limiting.

What is claimed is:

1. In a method for extracting oil and other hydrocarbons from oil shale, tar sand, coal, lignite and like hydrocarbonaceous solid material, the steps of advancing discrete individual pieces of said hydrocarbonaceous solid material along a pathway in a substantially evacuated system at a pressure no more than about 50 torr, said substantially evacuated system being in communication with at least one condenser surface, supplying heat energy to said pieces of hydrocarbonaceous material to raise the temperature thereof to within the range from about 600° to no more than 900° F. to cause the oil and other hydrocarbons therein to be liberated as a vapor in said evacuated system, and thereafter selectively condensing and recovering the oil from said vapor.

2. A method as in claim 1 wherein said pressure is within the range from 1 to 10 torr.

3. A method as in claim 1 wherein said pieces of said hydrocarbonaceous solid material are preheated at a temperature within the range from 300° to 600° F. to preliminarily remove water and hydrocarbons which vaporize at temperatures below about 600° F.

4. A method as in claim 1 wherein said substantially evacuated pathway is in communication with a plurality of condenser surfaces maintained at varying temperatures and which function to permit fractional condensing and recovery of oil from said liberated vapor.

5. A method as in claim 1 wherein radiant heat energy is supplied by a black body source heated to a temperature within the range from about 900° to 1500° F.

6. A method as in claim 1 wherein said discrete individual pieces of hydrocarbonaceous solid material are advanced along said pathway for a period on the order of 30 to 360 minutes.

7. A method as in claim 1 wherein pressure in said evacuated system is below about 10 torr, the temperature of said advancing pieces of said hydrocarbonaceous solid material is below 700° F., and the time to remove at least 50% of the oil present in said material is less than about 70 minutes.

8. A method as in claim 1 for treating coal to recover oil therefrom and to cleanse the same of impurities wherein heat energy is supplied to discrete pieces of coal to raise the temperature thereof to within said range from about 600° to no more than 900° F., to cause oil and volatile impurities in the coal to be liberated as vapors in said evacuated system, followed by condensing the liberated vapors to recover said oil and impurities as by-products while simultaneously recovering the coal as a source of clean heat energy.

9. A continuous method for the recovery of oil from oil shale comprising the steps of breaking the oil shale into discrete individual pieces, preheating said pieces at a temperature below about 600° F. to drive out water and hydrocarbons which volatilize at temperatures below 600° F., advancing the discrete individual pieces along a pathway in an evacuated, substantially air-free system wherein the pressure is below about 50 torr, said pathway being in communication with a plurality of condenser surfaces, supplying heat energy to the advancing pieces of material to raise the temperature of the pieces to not greater than 900° F., the conditions of evacuated pressure and temperature being such that oil present in said oil shale is liberated as a vapor in said evacuated system, maintaining the temperature of said plurality condenser surfaces at different temperatures within the range from about 300° to −200° F. to facilitate fractional condensing of hydrocarbon components in said liberated vapor, and fractionally condensing said hydrocarbons to recover the same.

* * * * *